US010465365B2

(12) United States Patent
Guthrie

(10) Patent No.: US 10,465,365 B2
(45) Date of Patent: Nov. 5, 2019

(54) TOILET PLUNGER WITH TELESCOPING HANDLE

(71) Applicant: Kevin J. Guthrie, Wind Lake, WI (US)

(72) Inventor: Kevin J. Guthrie, Wind Lake, WI (US)

(73) Assignee: Lavelle Industries, Inc., Burlington, WI (US)

( * ) Notice: Subject to any disclaimer, the term of this patent is extended or adjusted under 35 U.S.C. 154(b) by 0 days.

(21) Appl. No.: 15/910,200

(22) Filed: Mar. 2, 2018

(65) Prior Publication Data

US 2019/0270192 A1 Sep. 5, 2019

(51) Int. Cl.
*E03C 1/308* (2006.01)
*B25G 1/04* (2006.01)

(52) U.S. Cl.
CPC ..... *E03C 1/308* (2013.01); *B25G 1/04* (2013.01)

(58) Field of Classification Search
CPC .. E03C 1/30; E03C 1/302; B25G 1/04; B25G 1/043; B25G 1/046; B62B 5/065; B62B 5/067; B26B 21/523; A45C 13/26; A45C 13/262; A45C 2013/265; A45C 2013/267
USPC ..... 4/255.01–255.12; 16/111.1, 113.1, 405, 16/406, 409, 410, 429; 15/144.4; 248/145.6
See application file for complete search history.

(56) References Cited

U.S. PATENT DOCUMENTS 3,998,476 A * 12/1976 Kazmark, Sr. ..... B62B 1/125 280/655
5,305,882 A * 4/1994 Kaplan ..... A46B 5/0033 15/144.4
5,661,868 A * 9/1997 Panagakos ..... A46B 5/0033 15/144.4
6,055,680 A * 5/2000 Tolbert ..... E03C 1/308 4/255.11
6,546,596 B2 * 4/2003 Grote ..... B05C 17/0205 15/143.1
6,766,559 B2 * 7/2004 Roney ..... A47L 9/325 15/363
7,089,605 B2 * 8/2006 Jiang ..... E03C 1/308 16/429
8,312,572 B2 * 11/2012 Heffner ..... E03D 9/00 4/255.01
9,427,854 B2 * 8/2016 Leighton ..... B25B 13/06
D809,720 S * 2/2018 Salas ..... D32/14

* cited by examiner

*Primary Examiner* — Erin Deery
(74) *Attorney, Agent, or Firm* — Joseph S. Heino; Erin E. Kaprelian

(57) ABSTRACT

A device may comprise a lower handle and an upper handle. The lower handle may further comprise an opening disposed along the length of the lower handle, a key channel disposed on an inner surface of the lower handle, and a key stop integrally formed with the key channel. The upper handle may further comprise an integrally formed key to engage with the key channel, a spring clip including a spring clip button and an O-ring. The upper handle may further include an integrally formed top handle extending perpendicular to the upper handle.

11 Claims, 3 Drawing Sheets

TOILET PLUNGER WITH TELESCOPING HANDLE

BACKGROUND

Devices such as toilet plungers often include a handle having a fixed length. Moreover, these devices often come with a holder in which to rest the device when not in use. In storage, therefore, the device may be stored together with the holder.

DETAILED DESCRIPTION

Figure 1:
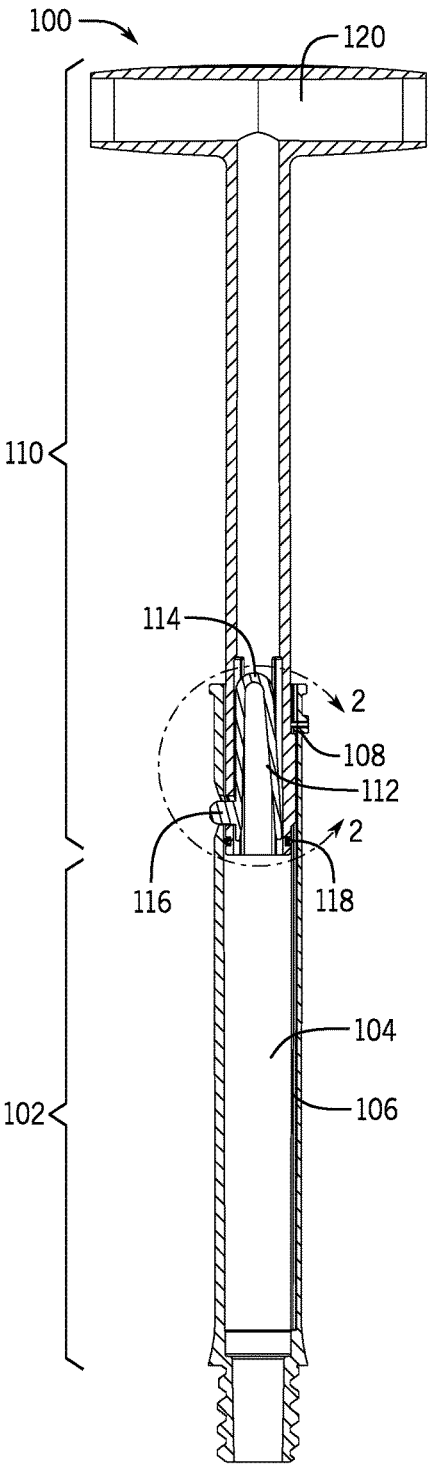
FIG. 1 is an example toilet plunger with telescoping handle consistent with the present disclosure.

Toilet plungers, and similar devices, typically include a handle having a fixed length. This handle is important as it provides additional leverage while using the plunger, as well as allowing a user to remain a fixed distance away from the bulbous plunger element, or bulb, of the plunger during use. In addition, toilet plungers often come with a separate holder. The holder may be designed to receive the bulb and hold the plunger when it is not in use. This may contain the plunger and assist in preventing residual water and other residue from getting onto the floor or other surface.

Although both the extended handle and the holder serve important functions to the use and storage of a toilet plunger, they may make storage of the toilet plunger difficult. For example, an extended handle, particularly when coupled with a holder, may result in a toilet plunger/holder combination that is too tall to be stored in a cabinet, such as an under-sink cabinet in a bathroom. Of course, the toilet plunger and holder may be stored outside a cabinet, e.g., on the floor; however, this may be less than desirable aesthetically. A shorter handle may also be used; however, a shorter handle results in a shorter distance between a user and the bulb of the plunging device when the device is in use, which may also be undesirable as it increases the risk of wastewater splash back.

A telescoping handle may allow a device, such as a plunging device, to have a plurality of handle lengths. As used herein, a telescoping handle refers to a handle that is able to move between at least two positions such that the handle is able to have at least two lengths. As a result, a plunging device that includes a telescoping handle may allow for greater distance between a user and the bulb of the device when the device is in use while also allowing the handle to be collapsed or retracted for storage after use.

However, a telescoping handle may not be as sturdy as a handle that remains one length. This may be the result of, for example, the "catch" of the handle, i.e., the piece of the handle that locks the handle into position, becoming worn or damaged from repeated use. Additionally, telescoping handles may also come apart. That is, the upper portion of the handle and the lower portion of the handle may separate if pulled or pushed with too much force. As a result, a user may need to touch the bulb of the plunging device in order to collapse the telescoping handle. This may create sanitary concerns, and may additionally impact use of the plunging device, as the handle may come apart due to the force used during plunging. Moreover, when in a retracted position, the telescoping handle may lack the strength to carry the plunging device, with or without the holder, without extending. This may make it difficult to remove the plunging device from its storage location.

By contrast, the telescoping handle of the present application includes a key channel, formed in the lower handle, that includes an integrated key stop. The key stop may receive a key in the upper handle to prevent additional movement by the upper handle during extension. Moreover, the key channel may include a roll pin to provide an additional measure to prevent movement by the upper handle during extension in the event that the key stop fails to catch the key. Thus, while in an extended position, the telescoping handle of the present application is precluded from unwanted movement. Moreover, the telescoping handle of the present application is prevented from disengaging and coming apart, particularly during use.

In addition, the telescoping handle of the present invention includes an O-ring disposed in the upper handle. When in a retracted position, the O-ring is able to interact with an interference gland located on the lower handle. This may result in the telescoping handle being retained in the retracted position until sufficient force is applied to overcome the interaction between the O-ring and the interference gland. As a result, the handle may remain in the retracted position during movement of the plunging device, with or without a holder, and only extend when a user pulls up on the handle.

FIG. 1 is an example telescoping handle 100 consistent with the present disclosure. Handle 100 may include a lower handle 102. Lower handle 102 may include an opening 104 disposed along its length. Lower handle 102 may further include a key channel 106 disposed on an inner surface thereof. As used herein, a key channel refers to a grooved cutout to receive and engage with a corresponding structure on a complementary surface. The key channel 106 may interact with a key disposed on an upper handle of handle 100, discussed further herein.

Lower handle 102 may further include a key stop 108. As used herein, a key stop refers to a protruding structure to engage with a key, or a portion of a key, such that the key is prevented from moving past the key stop. In some examples, key stop 108 may engage with a corresponding cutout of a key. Key stop 108 may be integrally formed with the key channel 106. That is, the key stop 108 may be formed as part of the key channel 106. In some examples, the key stop 108 may be disposed at an upper end of the key channel 106 and/or at an upper end of the lower handle 102.

Handle 100 may further include an upper handle 110. Upper handle 110 may be disposed above lower handle 102, as shown in FIG. 1. Upper handle 110 may slidably engage with the lower handle 102. In some examples, upper handle 110 may slidably engage with the lower handle 102 at the opening 104 of the lower handle 102. Said differently, upper handle 110 may be insertable into lower handle 102 at the opening 104. In some examples, the upper handle 110 may slidably engage with the lower handle 102 by the key channel 106, discussed further herein. Upper handle 102 may slidably engage with lower handle 102 such that upper handle 102 is able to be in either an extended position or a retracted position.

Upper handle 110 may include a key 112. As used herein, a key refers to a protruding structure to engage with a channel, such as key channel 106. Key 112 may be disposed along a length of upper handle 110. In some examples, key 112 may extend along a length of upper handle 110 that is less than the total length of upper handle 110. This may allow upper handle 110 to slide with respect to lower handle 102 at the key 112 and key channel 106, such that the upper handle 110 is able to move between an extended position and a retracted position as described previously.

Upper handle 110 may further include a spring clip 114. As used herein, a spring clip refers to a shaped fastener that uses an elastic force to open and close. Spring clip 114 may include a spring clip button 116. As used herein, a spring clip button refers to a compressible protrusion on a side of a spring clip, such as spring clip 114, that engages the spring clip when pressure is applied to the spring clip button. Spring clip 114 and spring clip button 116 are discussed further herein with respect to FIG. 2.

Further, upper handle 110 may include an O-ring 118. As used herein, an O-ring refers to a circular, ring-shaped gasket used to form a seal. O-ring 118 may be disposed at a lower end of the key 112 and may interact with a structure on the lower handle 102 when the upper handle 110 is in the retracted position. O-ring 118 is discussed further herein with respect to FIGS. 2 and 4.

Upper handle 110 may also include a top handle 120. Top handle 120 may be integrally formed with upper handle 110 and may extend from the upper handle 110 in a substantially perpendicular manner. The top handle 120 may be similar to the handle shown in Design application No. 29/580,045, assigned to Lavelle Industries, Inc., the contents of which are hereby incorporated by reference.

Figure 2:
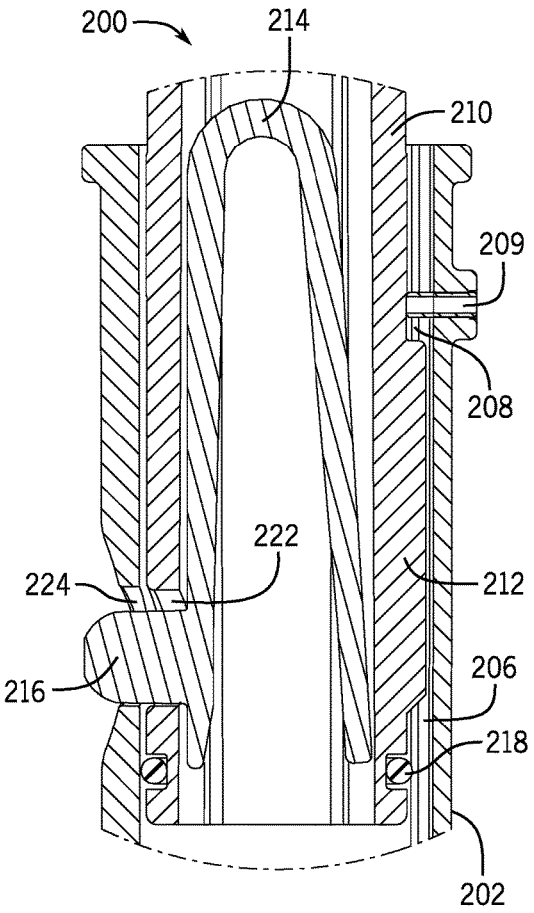
FIG. 2 is an example detail of the telescoping handle of FIG. 1, taken along Line C, consistent with the present disclosure.

FIG. 2 is an example detail of the telescoping handle of FIG. 1, taken along Line C, consistent with the present disclosure. Telescoping handle 200 includes a lower handle 202. Lower handle 202 may be akin to lower handle 102, discussed with respect to FIG. 1. Handle 200 further includes an upper handle 210. Upper handle 210 may be akin to upper handle 110, discussed with respect to FIG. 1.

As described with respect to FIG. 1, lower handle 202 may include a key channel 206. Key channel 206 may be disposed along an interior side of lower handle 202. As shown in FIG. 2, key channel 206 may engage a corresponding key 212. Key 212 may be part of upper handle 210. Key 212 may comprise an integrally formed protrusion extending from upper handle 210. Key channel 206 and key 212 may be complementarily sized such that key 212 is able to engage with key channel 206. As described previously, upper handle 210 may slidably engage with lower handle 202. Thus, key 212 may slide along key channel 206 to permit upper handle 210 to slide with respect to lower handle 202.

Disposed at an upper end of key channel 206 may be a key stop 208. Key stop 208 may be akin to key stop 108, described with respect to FIG. 1. As shown in FIG. 2, key stop 208 may extend perpendicularly with respect to the key channel 206. In some examples, the key stop 208 may be integrally formed with the key channel 206. That is, key stop 208 may formed as a part of key channel 206. Key stop 208 may engage with a corresponding cutout of key 212. Upon engagement of the key 212 by key stop 208, upper handle 210 may be prevented from moving further with respect to lower handle 202. Said differently, engagement at the key stop 208 of the key 212 may "lock" the upper handle 210 into the extended position.

Lower handle 202 may further include a roll pin 209. As used herein, a roll pin refers to a pin extending perpendicularly from the key channel. Roll pin 209 may be located above the key stop 208, as shown in FIG. 2. In some examples, roll pin 209 may be integrally formed with key channel 206. Roll pin 209 may serve to engage the cutout of the key 212, similar to key stop 208. That is, roll pin 209 may "catch" the cutout of key 212, such that key 212 is prevented from further movement. As a result, when key 212 is engaged with roll pin 209, upper handle 210 may be prevented from further extension with respect to lower handle 202. In some examples, roll pin 209 may serve as a backup to key stop 208; that is, roll pin 209 may prevent over-extension of upper handle 210 should the cutout of the key 212 be pulled past the key stop 208.

Spring clip 214 may be disposed within upper handle 210. Spring clip 214 may be akin to spring clip 114, described with respect to FIG. 1. As shown in FIG. 2, the legs of spring clip 214 may be located substantially perpendicular to the key 212. Spring clip 214 may compress upon application of a force thereto. When spring clip 214 is compressed, upper handle 210 may slide within the lower handle 202. That is, compression of spring clip 214 may move spring clip 214 to be contained within the upper handle 210 such that key 212 of upper handle 210 may slidably engage with key channel 206.

Spring clip 214 may include a spring clip button 216. Spring clip button 216 may be akin to spring clip 116, described with respect to FIG. 1. Spring clip button 216 may be integrally formed with spring clip 214 such that spring clip button 216 may assist in compressing spring clip 214. Said differently, spring clip button 216 may be compressible and, when compressed, may compress spring clip 214. As shown in FIG. 2, spring clip button 216 may be disposed on a leg of spring clip 214 opposite the key 212 and key channel 206.

Handle 200 may further include first locking hole 222 and a second locking hole 224. As used herein, a locking hole refers to a cutout or hole to receive a protrusion such that, upon receipt, the protrusion, along with the thing the protrusion is attached to, is locked into place. In the present instance, the locking holes 222, 224 may receive the spring clip button 216. First locking hole 222 may be disposed in the upper handle, while second locking hole 224 may be disposed in the lower handle. Both first locking hole 222 and second locking hole 224 may be located on their respective handles opposite the key stop 206 such that first locking hole 222 is aligned with second locking hole 224.

In operation, as shown in FIG. 2, spring clip button 216 may engage with the locking holes 222, 224. IN some examples, spring clip button 216 may engage with the locking holes 222, 224 when the cutout of key 212 engages with key stop 208. Said differently, engagement of key 212 with key stop 206 may correspond to engagement of spring clip button 216 with locking holes 222, 224. As a result, spring clip button 216 may provide an additional point of interference between the upper handle 210 and the lower handle 202, such that when in the extended position, upper handle 210 is unable to move with respect to lower handle 202. In some examples, spring clip 202 is released when the upper handle 210 is extended from the lower handle 202; release of spring clip 214, thus, may permit spring clip button to engage with the locking holes 222, 224.

Upper handle 210 may further include an O-ring 218. O-ring 218 may be akin to O-ring 118, described with respect to FIG. 1. O-ring 218 may disposed at a lower end of key 212. When upper handle 210 is in its extended position, as shown in FIG. 2, O-ring 218 may not be engaged with a corresponding structure. However, O-ring 218 may engage with a structure on the lower handle 202 when the upper handle 210 is in the retracted position. The interaction of O-ring 218 with another structure is discussed further herein with respect to FIG. 4.

Figure 3:
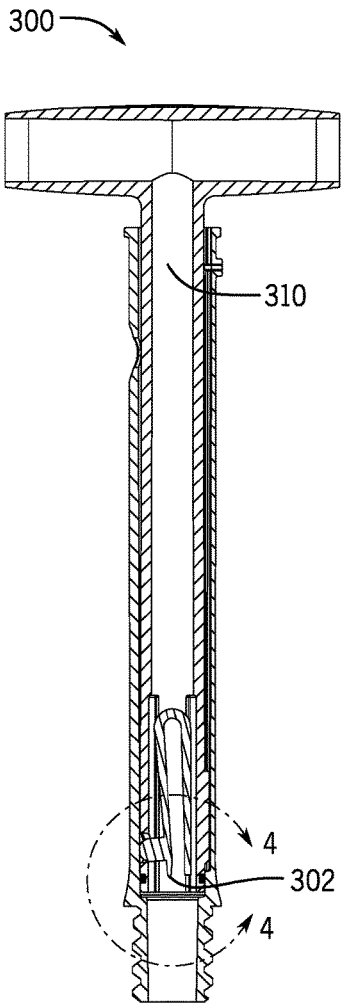
FIG. 3 is another example telescoping handle consistent with the present disclosure.

FIG. 3 is another example telescoping handle 300 consistent with the present disclosure. More particularly, FIG. 3 shows telescoping handle 300 in the retracted position. Handle 300 includes a lower handle 302 and an upper handle 310. As shown in FIG. 3, when handle 300 is in the retracted position, upper handle 310 is inserted into and contained within upper handle 302. Upper handle 310 is able to be inserted into lower handle 302 due to lower handle 302 being substantially hollow. That is, the opening 104, discussed with respect to FIG. 1, may be disposed along the length of the lower handle, rendering the lower handle hollow.

Figure 4:
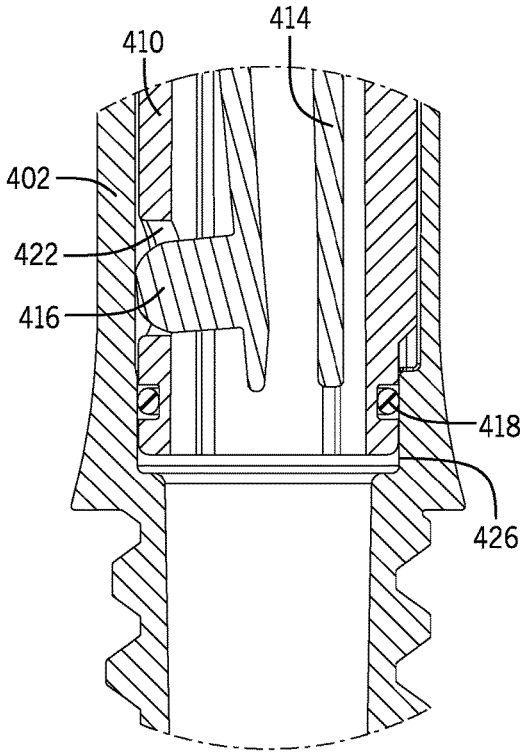
FIG. 4 is an example detail of the telescoping handle of FIG. 3, taken along Line D, consistent with the present disclosure.

FIG. 4 is an example detail of the telescoping handle of FIG. 3, taken along Line D, consistent with the present disclosure. As in FIG. 3, the handle shown in FIG. 4 in the retracted position, with upper handle 410 inserted into the lower handle 402. When in the retracted position, spring clip 414 is in a compressed position. As previously described, the compression of spring clip 414 may permit upper handle 410 to be inserted into the lower handle 402, thus enabling the retracted position. Moreover, spring clip button 416 is compressed. That is, spring clip button 416 is not engaged with locking holes, such as locking holes 222, 224, described with respect to FIG. 2. As shown in FIG. 4, locking hole 422, that is, the locking hole in upper handle 410, may still be present and aligned with the spring clip button 416, as the locking hole 422 is integral with the upper handle 410. However, the spring clip button 416 may be prevented from extending through locking hole 422, and thus from locking upper handle into position, by the side wall of lower handle 402. Said differently, spring clip button 416 may attempt to engage with locking hole 422 but, due to locking hole 422 not being aligned with the second locking hole (and thus not being open), spring clip button 416 may be unable to do so. Additionally, preventing spring clip button 416 from engaging with locking hole 422 may assist spring clip 414 in remaining under compression.

Lower handle 402 may further include an interference gland 426. As used herein, an interference gland refers to a structure designed to accept and engage an O-ring. Thus, interference gland 426 may engage O-ring 418, located at a lower end of the upper handle 410. When upper handle 410 is inserted into lower handle 402, O-ring 418 may engage with interference gland 426. Upon engagement, interference gland 426 may hold O-ring 418 in place, and thus keep upper handle 410 inserted into lower handle 402. The interference gland 426 may engage O-ring 418 with sufficient force to permit the plunging device (of which handle 400 is a part) to be carried without the O-ring 418 disengaging. That is, interference gland 426 may hold O-ring 418 strongly enough to allow the plunging device to be carried and still remain in the retracted position, with upper handle 410 inserted into the lower handle. However, the force between interference gland 426 and O-ring 418 may be weak enough that upper handle 410 is able to be extended from lower handle 402 for use by pulling up on upper handle 410.

Figure 5:
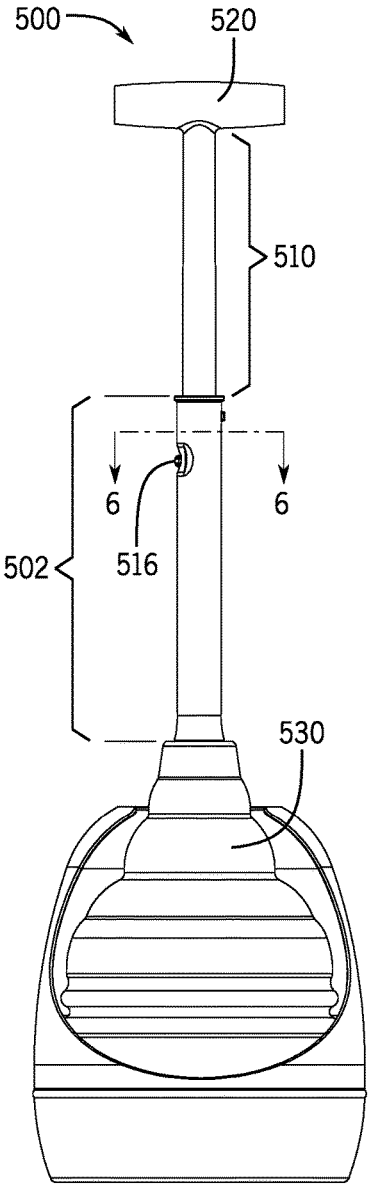
FIG. 5 is an example plunging device including a telescoping handle consistent with the present disclosure.

FIG. 5 is an example plunging device 500 including a telescoping handle consistent with the present disclosure. As shown in FIG. 5, the telescoping handle of plunging device 500 is in the extended position; that is, upper handle 510 is not inserted into lower handle 502. As previously described, spring clip button 516 is engaged, such that upper handle 510 is locked into position with respect to lower handle 502.

Upper handle 510 may include a top handle 520. Top handle 520 may be akin to top handle 120, described with respect to FIG. 1. As shown in FIG. 5, top handle 520 may be disposed perpendicularly to upper handle 510.

Plunging device 500 may further include a bulb 530. As used herein, a bulb refers to a hollow, flexible container that is open at one end such that air can be expelled from the bulb by squeezing. As shown in FIG. 5, bulb 530 may be substantially teardrop shaped, although examples are not so limited. Although not shown, bulb 530 may include an opening disposed opposite the point of attachment between bulb 530 and lower handle 502. Bulb 530 may be manufactured from rubber, synthetic rubber, or any other material having a suitable durometer such that bulb 530 is flexible and able to be compressed and expanded. In some examples, bulb 530 may be treated with an additive or solution to increase the chemical resistance of the material. Such material may include the CHLORAZONE® polymer (CHLORAZONE is a registered mark of Lavelle Industries, Inc.).

Figure 6:
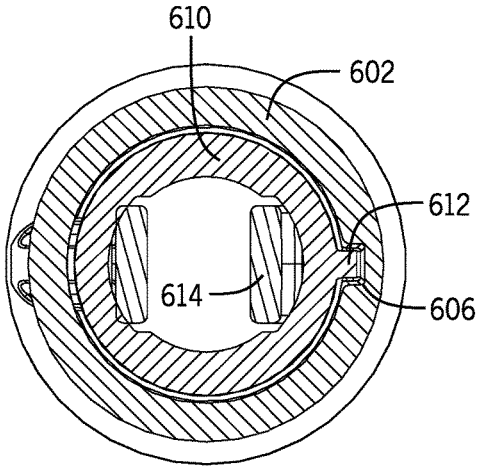
FIG. 6 is an example detail of the telescoping handle of FIG. 5, taken along Line E-E, consistent with the present disclosure.

FIG. 6 is an example detail of the telescoping handle of FIG. 5, taken along Line E-E, consistent with the present disclosure. More particularly, FIG. 6 shows an example cross-sectional view of the telescoping handle 500 of FIG. 5. As shown in FIG. 6, upper handle 610 may be inserted into lower handle 602. Thus, the lower handle 602 may have a first diameter and the upper handle 610 may have a second diameter that is less than the first diameter. FIG. 6 further shows the engagement of key 612 with key channel 606. As described previously, key channel 606, located within lower handle 602, may receive key 612, located on upper handle 610, and allow key 612 to slide along key channel 606. This may allow upper handle 610 to slidably engage with lower handle 602. Further, upper handle 610 may include a spring clip 614. As shown in FIG. 6, spring clip 614 may comprise two legs, with one leg being disposed on each side of the inner handle 610. Spring clip 614 may be compressible, as previously discussed, and may further provide an additional means of locking upper handle 610 with respect to lower handle 602 by means of a spring clip button (not shown in FIG. 6).

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure. It is to be understood that other examples may be utilized and that changes may be made without departing from the scope of the present disclosure.

The figures herein follow a numbering convention in which the first digit corresponds to the drawing figure number and the remaining digits identify an element or component in the drawing. Like digits should be taken to identify like drawings, with the different first digits corresponding to the drawing figure. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure and should not be taken in a limiting sense.

The invention claimed is:

1. A device, comprising:

a lower handle, the lower handle further comprising:

an opening disposed along the length of the lower handle;

a key channel disposed on an inner surface of the lower handle;

a key stop integrally formed with the key channel; and an integrally formed roll pin located above the key stop in the key channel; and an upper handle, the upper handle further comprising:

an integrally formed key to engage with the key channel;

a spring clip, wherein the spring clip includes a spring clip button;

an O-ring; and an integrally formed top handle extending perpendicular to the upper handle.

2. The device of claim 1, wherein the roll pin extends perpendicularly from the key channel to engage the key when the upper handle is extended such that the upper handle is prevented from further extension.

3. The device of claim 1, wherein the key stop comprises a protrusion extending perpendicularly from the key channel to engage a corresponding cutout in the key when the upper handle is extended.

4. The device of claim 3, wherein the spring clip button engages with a first locking hole and a second locking hole when the key stop engages the key.

5. A device, comprising:

an upper handle, the upper handle further comprising:

an integrally formed key, wherein the key includes a cutout;

a spring clip including a spring clip button;

a first locking hole disposed opposite the key;

an O-ring; and an integrally formed top handle extending perpendicular to the upper handle; and a lower handle, the lower handle further comprising:

an opening disposed along the length of the lower handle;

a key channel disposed on an inner surface of the lower handle;

a key stop integrally formed with the key channel, wherein the key stop comprises a protrusion to engage with the cutout of the key;

a roll pin integrally formed within the key channel and located above the key stop;

an interference gland disposed at a lower end of the lower handle; and a second locking hole disposed such that the second locking hole is aligned with the first locking hole when the upper handle is in an extended position with respect to the lower handle; and a cup coupled to the lower handle.

6. The device of claim 5, wherein:

the lower handle has a first diameter; and the upper handle has a second diameter that is less than the first diameter such that the upper handle is insertable into the lower handle.

7. The device of claim 5, wherein the upper handle is slidably engageable with the lower handle such that the key is slidably engageable with the key channel.

8. The device of claim 7, wherein the cutout of the key engages with the protrusion of the key stop such that the upper handle is locked with respect to the lower handle.

9. The device of claim 7, wherein the cutout of the key engages with the roll pin such that the upper handle is locked with respect to the lower handle.

10. The device of claim 5, wherein:

the spring clip is compressed when the upper handle is inserted into the lower handle; and the spring clip released when the upper handle is extended from the lower handle such that the spring clip button engages at the first locking hole and the second locking hole.

11. The device of claim 5, wherein the interference gland engages the O-ring when the upper handle is inserted into the lower handle.

* * * * *